US010969170B2

(12) United States Patent
Grunwald et al.

(10) Patent No.: US 10,969,170 B2
(45) Date of Patent: Apr. 6, 2021

(54) DYNAMIC STATE CONFIGURATION FOR PADDLE PROCESSOR

(71) Applicant: Komline-Sanderson Corporation, Peapack, NJ (US)

(72) Inventors: Douglas W. Grunwald, Andover, NJ (US); Timothy J. Riley, Easton, PA (US); Fred H. Jackson, Jr., South Bound Brook, NJ (US)

(73) Assignee: KOMLINE-SANDERSON CORPORATION, Peapack, NJ (US)

( * ) Notice: Subject to any disclaimer, the term of this patent is extended or adjusted under 35 U.S.C. 154(b) by 107 days.

(21) Appl. No.: 16/184,064

(22) Filed: Nov. 8, 2018

(65) Prior Publication Data

US 2020/0149811 A1 May 14, 2020

(51) Int. Cl.

| | |
|---|---|
| ***F26B 3/32*** | (2006.01) |
| ***F26B 3/24*** | (2006.01) |
| ***F26B 25/00*** | (2006.01) |
| ***F26B 17/20*** | (2006.01) |
| ***F26B 3/20*** | (2006.01) |

(52) U.S. Cl.

CPC ..... *F26B 3/24* (2013.01); *F26B 3/20* (2013.01); *F26B 17/20* (2013.01); *F26B 25/001* (2013.01)

(58) Field of Classification Search

CPC ..... F26B 15/00; F26B 15/02; F26B 15/04; F26B 15/18; F26B 15/20; F26B 15/24; F26B 3/24; F26B 25/001; F26B 17/20; F26B 3/20

USPC .... 34/586, 580, 519, 423, 424; 222/54, 625, 222/624

See application file for complete search history.

(56) References Cited

U.S. PATENT DOCUMENTS

| | | | | |
|---|---|---|---|---|
| 4,770,236 | A * | 9/1988 | Kulikowski | F26B 17/20 165/86 |
| 5,378,376 | A * | 1/1995 | Zenner | B01D 21/22 210/776 |
| 9,950,331 | B2 * | 4/2018 | Phillips | B01J 2/006 |
| 2014/0208606 | A1 * | 7/2014 | Mathis, Jr. | F26B 3/0923 34/164 |

* cited by examiner

*Primary Examiner* — John P McCormack

(74) *Attorney, Agent, or Firm* — Buckley, Maschoff & Talwalkar LLC

(57) ABSTRACT

Provided is a paddle processor and a method for processing material within the paddle processor. In one example, the paddle processor may include a trough comprising an inlet to receive a feed of material and an outlet for exiting the material after processing, rotational paddles disposed in the trough and configured to rotate about each other to move the material from the inlet to the outlet, an overflow weir disposed in association with the outlet and having a dynamically adjustable height for controlling a rate at which the material exits the trough, and a control system configured to dynamically adjust the height of the overflow weir and/or other dryer parameters based on a temperature of the material within the trough.

20 Claims, 5 Drawing Sheets

DYNAMIC STATE CONFIGURATION FOR PADDLE PROCESSOR

BACKGROUND

A paddle dryer (also referred to as a paddle processor, etc.) is an efficient, mechanically agitated, indirect heat transfer device that can add or remove heat from a process mass in the form of a liquid, a paste, a cake, a granule, or the like. The paddle dryer may be used for indirect drying, heating, cooling, pasteurization, crystallizing, reacting of material, and the like. A paddle dryer may include one or more shafts such as a single shaft, dual counter-rotating shafts, etc. with unique intermeshing wedge shape paddles, and the like, which produce intimate mixing and optimize heat transfer to the material held within. The paddles may be hollow allowing for optimal heat transfer. For example, steam, oil, thermal fluid, water, glycol, or the like, may be introduced into the paddles to cause the paddles to heat up or chill down. The paddles in turn contact the material thereby isolating the heating/cooling liquid/gas from the process mass.

As one example, a thickened sludge (i.e., dewatered manure) may be fed into the paddle dryer in the form of a liquid, paste, etc., and converted into a granular powder that can be used as fertilizer, etc. As the sludge moves through the dryer (e.g., over the course of hours, etc.) the material slowly turns from a paste to a dry granule. One of the difficulties with paddle dryers is the ability to control the temperature of the product within the dryer. Typically, if the material (e.g., sludge, etc.) coming out of the dryer is too dry, an operator will lower the temperature of the paddle dryer to compensate. Likewise, if the material coming out of the paddle dryer is too wet the operator will raise the temperature of the paddle dryer to compensate.

However, raising/lowering the temperature of the paddle dryer raises/lowers the temperature throughout the entire paddle dryer (e.g., paddles) including the front end where the material is being fed to the back-end where the material is coming out. While the changes in temperature may quickly address the issue at the backend having the material which is too wet/dry, it may also cause reverse negative effects on new material entering at the front of end the paddle dryer (i.e., causing it to turn out too dry or too wet) during processing. As a result, the process will ping-pong back and forth creating a material that is either too dry or too wet, requiring an operator to continually raise/lower the dryer to accommodate changes to the consistency of the material being output.

Furthermore, as material dries in the backend of the dryer it loses a significant amount of water content to the point where the surface moisture of the product has such little water content (e.g., moisture content of 10% or less) that it needs a greater temperature than 212° to further dry the material. As a result, the material within the backend of the paddle dryer has to be heated to a higher temperature (e.g., 240°, etc.) to continue the drying process. Here, the outside of the material particles may be 240° but the inside of the particle is just reaching 212° because of transient heat conduction inside the particle. As a result, the temperature often has to be driven up a significant amount to accommodate the particles with less water content.

Besides the transient heat transfer component there is also a diffusion component that takes places. As noted, there is a critical moisture content (e.g., moisture content of 10% or less) where the surface moisture of a particle is depleted leaving behind internal bound or interstitial moisture. At this point two things happen to evaporate the remaining moisture. First, the surface of the particle heats up and this heat is then conducted inside the particle. This heat then evaporates the water inside the particle which then migrates out of the particle. At the same time, water inside the particle diffuses outward towards the particle surface. Once it reaches the surface (or perhaps on it's way to the surface) it evaporates. In the time it takes for the water to diffuse to the surface, the surface of the particle heats up. The result is that particles often heat up above 212° F. as you remove the last 10% or so of moisture.

Accordingly, what is needed is an improved mechanism for managing temperature of material being processed by a paddle dryer that does not rely on raising/lowering the temperature of the paddle dryer or making manual/static adjustments by the dryer operator.

SUMMARY

The example embodiments improve upon the prior art by providing a paddle processor that is capable of automatically adjusting an amount of time that a material spends within the paddle processor by dynamically actuating an overflow weir and thereby controlling a rate at which material leaves the paddle processor. The paddle processor may include a control system that receives temperature measurements of the material as it moves through a body/trough thereof. Based on the temperature measurements, the control system may raise the overflow weir to keep the material within the trough for longer time, or lower the overflow weir to release the material more quickly than planned.

According to an aspect of an example embodiment, a paddle processor may include one or more of a trough comprising an inlet to receive a feed of material and an outlet for exiting the material after processing, rotational paddles disposed in the trough and configured to rotate about each other to move the material from the inlet to the outlet, an overflow weir disposed in association with the outlet and having a dynamically adjustable height for controlling a rate at which the material exits the trough, and a control system configured to dynamically adjust the height of the overflow weir based on a temperature of the material within the trough.

According to an aspect of another example embodiment, a method of a paddle processor may include one or more of feeding material into an inlet of a trough housing a plurality of paddles rotating about each other causing the material to move towards an outlet of the trough, heating or cooling one or more of the rotational paddles to process the material while it is within the trough, detecting a temperature of the material while it is within the trough, and dynamically adjusting a state of one or more components of the paddle processor based on the detected temperature of the material thereby dynamically adjusting temperature of the material within the trough. Other embodiments may optionally include additional paddle dryer settings based on process material, dryer and/or process characteristics such as adjusting the temperature of the thermal media running through the agitator and/or trough jacket or the feed rate of the process material.

Other features and aspects may be apparent from the following detailed description taken in conjunction with the drawings and the claims.

BRIEF DESCRIPTION OF THE DRAWINGS

Features and advantages of the example embodiments, and the manner in which the same are accomplished, will become more readily apparent with reference to the following detailed description taken in conjunction with the accompanying drawings.

Figure 1:
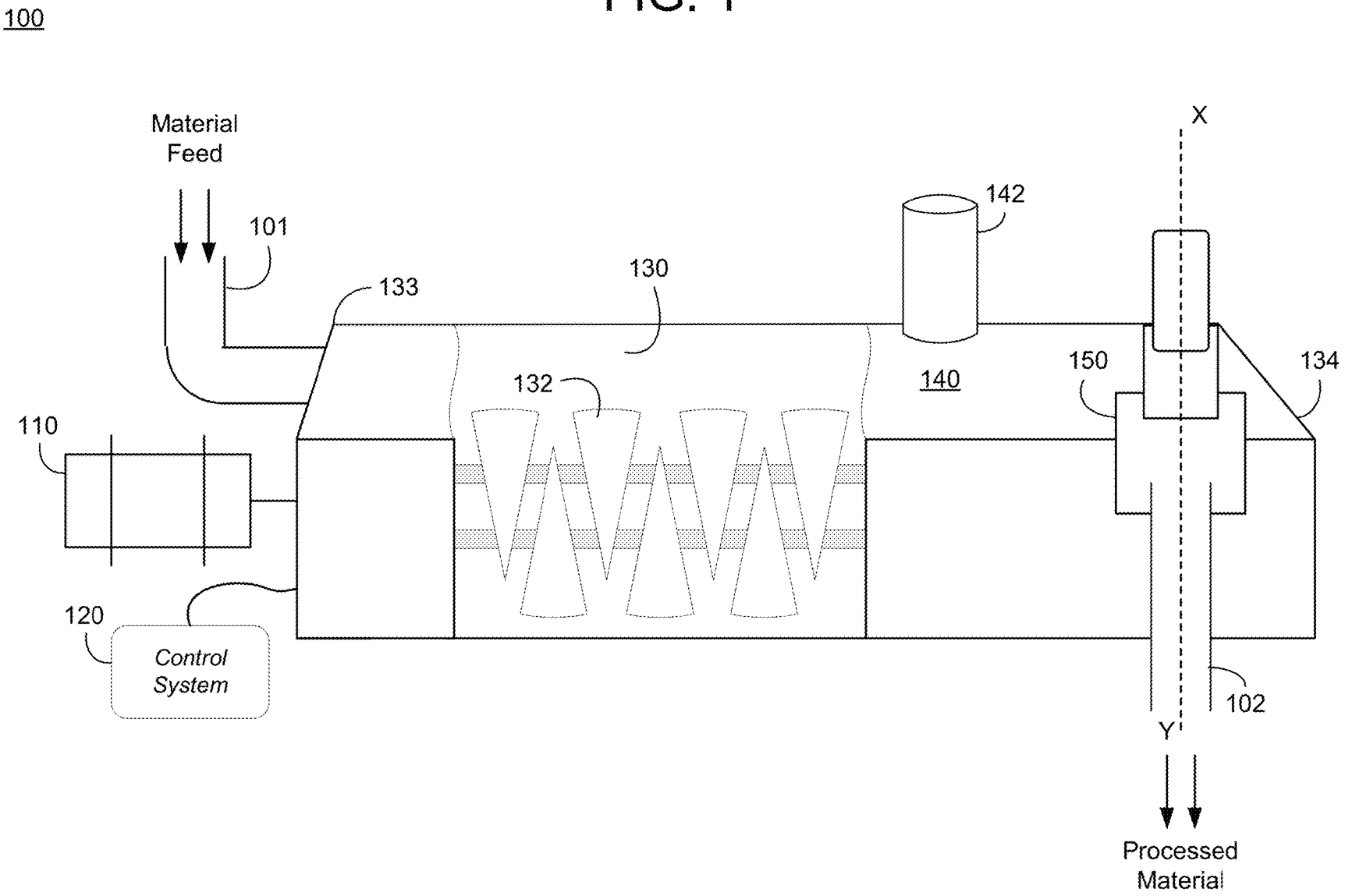
FIG. 1 is a diagram illustrating an overview diagram of a paddle processor in accordance with an example embodiment.

Throughout the drawings and the detailed description, unless otherwise described, the same drawing reference numerals will be understood to refer to the same elements, features, and structures. The relative size and depiction of these elements may be exaggerated or adjusted for clarity, illustration, and/or convenience.

DETAILED DESCRIPTION

In the following description, details are set forth to provide a thorough understanding of various example embodiments. It should be appreciated that modifications to the embodiments will be readily apparent to those skilled in the art, and generic principles defined herein may be applied to other embodiments and applications without departing from the spirit and scope of the disclosure. Moreover, in the following description, numerous details are set forth as an explanation. However, one of ordinary skill in the art should understand that embodiments may be practiced without the use of these specific details. In other instances, well-known structures and processes are not shown or described so as not to obscure the description with unnecessary detail. Thus, the present disclosure is not intended to be limited to the embodiments shown, but is to be accorded the widest scope consistent with the principles and features herein.

A paddle processor (e.g., a paddle dryer) is a machine that transfers heat to or from a mass of material as it is held within a trough of the paddle processor. For example, the paddle processor may heat the material by transferring heat to the material or it may cool the material by transferring heat from the material. Dual-rotating paddles intermesh with one another to mix and move the material within the trough. In some cases, the paddles have wedge-shaped designs which further improve the ability to mesh. The paddles may be filled with a heating liquid, gas, etc., such as steam, oil, thermal fluid, water, etc., which is indirectly used to heat/cool the material via indirect transfer of heating/cooling through the paddles. Paddle dryers can be used on food material (e.g., for drying/preserving the food), on sludge (for dewatering), on super absorbers (diapers, etc.), and the like, where the mass of material may contact a surface of the paddles which creates the indirect transfer of heating/cooling to thereby dry out the material as it moves through the processor.

For example, the paddle processor may be used to heat a process mass for melting, cooking, pasteurization, roasting or reacting material. The heating medium introduced within the paddles (and/or the walls of the trough) can be steam, circulated thermal fluid, hot water, and the like. Two-zone design may provide for two distinct temperature zones within the paddle processor. As another example, the paddle processor may be used to remove heat from (i.e., cool) a process mass with cold water or thermal fluid (glycol, down to −40° F.). Cooling can be done in a controlled moisture-free environment. Two-zone design allows for two distinct temperature zones.

In some examples, calcining at temperatures up to 750° F. can be done with the paddle processor. Evaporation of water prior to high temperature calcining will increase the capacity of the high temperature equipment, and the thermal efficiency of the process. As another example, reacting may be via the paddle processor for catalyzing and controlling reactions, taking advantage of the capability for precise temperature and residence time. It can be used for both exothermic and endothermic reactions. A high degree of mixing allows multiple ingredients to be thoroughly mixed as part of the reacting process. As another example, the paddle processor may be used for selective polymer crystallization or crystallizing at controlled rates and temperatures.

Various materials having various states/consistencies can be processed with the paddle processor. Examples of materials that can be processed include, but are not limited to, chemicals such as salts, catalyst, brominated organics, cellulose, starch, etc., petrochemicals such as solids devolatization, etc., polymers and plastics such as polypropylene, polycarbonate, polyphenylsulfide, PET, PTA, etc., food such as flour, beverage powders, confectionary ingredients, meat products, etc., and minerals and metals such as metal powders, metal carbonates, sulfates, hydroxides, etc.

In operation, material may be fed through an inlet of a trough or body of the paddle processor which houses the paddles. The material may be held within the trough for hours while the material dries. This time is also referred to herein as "residence time." The paddles may continuously rotate about each other causing the material to become dryer over time. Eventually, the material thickens from a liquid to a paste, etc., and then from a paste to a dried granule, etc. The dried granule is moved out of the trough via an outlet. Traditional paddle processors rely on operators to monitor a dryness/wetness of material as it exits the trough. Here, the operator may determine that the material is too dry (caused by the material being overheated) or that the material is too wet (caused by the material not being heated enough). In related systems, the operator may adjust a temperature of the paddles to apply more heat or less heat depending on whether the operator desires the material to be dryer or wetter.

As mentioned previously, the material may spend hours of time within the paddle processor. As a result, the effects of the increased/decreased temperature may help the material that is near the end of the dryer. However, the effects of the increased/decreased temperature may have a negative impact on the material that is towards the inlet of the dryer and has not been in the paddle processor as long. The result is that the opposite effect happens to the material. For example, the increased temperature may decrease wetness for material at the end of the dryer creating a desired dryness, however for the material that follows shortly after, the dryer may be too hot causing the material to be too dry. The opposite effect can occur when the operator decreases the temperature to increase the wetness. Such a decrease may add enough wetness to very dry material at the end of the processer giving it a desired dryness, but it may cause material at the beginning of the dryer to be too wet.

The example embodiments overcome this problem by dynamically controlling a state of one or more components of the paddle dryer to counteract a temperature of the material within the paddle dryer becoming too high or too low. For example, a control system may automatically adjust a height of an overflow weir that is positioned at an outlet of the paddle processor. Here, the overflow weir may be positioned at an end or along a side of the paddle processor towards an end that is opposite of the inlet and may control how much material is allowed to escape the outlet. In particular, the overflow weir may be controlled automatically based on a temperature of the material within the trough of the paddle processor. When the material is getting too dry (from being too hot) a control system may automatically detect the deviation from temperature target and lower the overflow weir allowing dried material to escape more quickly. Likewise, when the material is getting too wet (from not being hot enough) the control system may automatically raise the overflow weir causing the wetter material to be prevented from escaping until it has had more time drying in the trough.

The overflow weir can be activated up or down under the control of a control system rather than requiring a user to inspect material coming out of the paddle processor. Rather, sensors within the trough can sense a temperature of the material and feedback the sensed temperature to the control system. Based on a temperature moisture profile of the material, the control system may determine when to raise or lower the weir to keep the temperature of the material within a desired range, or sweet spot for drying.

As another example, the control system may automatically adjust a temperature and/or a flow rate of thermal fluid that is flowing through one or more trough components such as a jacket which surrounds an interior of the trough, trough actuators, or the like. The temperature of the thermal fluid may be changed throughout the trough or within selected portions of the trough as dynamically actuated by the control system or a user. As another example, the control system may dynamically adjust a feed rate at which material is initially being fed into an inlet of the trough. In some cases, states of multiple components may be controlled. For example, at least two components from among the overflow weir, the thermal fluid in the trough, and the inlet feed rate may be controlled.

FIG. 1 illustrates an overview of a paddle processor 100 in accordance with an example embodiment. For example, the paddle processor 100 may be used to heat/dry a material such as food, sludge, powder, paste, or the like. In this example, an exterior 140 of the paddle processor 100 is shown with a cutaway view of an interior of a trough 130 which makes a large portion of the body of the paddle processor 100. Inside the trough 130 is a plurality of paddles 132 which rotate about each other on shafts. Here, the paddles 132 may be arranged on dual shafts where paddles on the first shaft interlock or intermesh with paddles on the second shaft as the paddles/shafts rotate about one another. The interlocking shape may be used to create an optimal contact surface to transfer heat or transfer cold to the material. The paddles 132 may be driven by a motor 110 or multiple motors under the control of a control system 120 which may include a control panel or other interface enabling an operator to input commands.

In operation, a material may be fed into the paddle processor 100 via an inlet 101 which may include a hose, a shaft, an opening, and/or the like, capable of receiving material that is pumped in from a machine, shoveled in by hand, and/or the like. The material that is fed through the inlet 101 may slowly move from a front end 133 of the trough 130 to a rear end 134 of the trough 130 where the material exits out of a weir unit 150. Although not shown in FIG. 1, the weir unit 150 may fit over an outlet 154 (shown in FIG. 2) of the trough 130 which may include a hole, an opening, or the like. The weir unit 150 may include a dynamically adjustable overflow weir (153 shown in FIG. 2) which can be raised up or down automatically under the control of the control system 120. As the material is heated, gas from the interior of the trough 130 may exit an exhaust 142 positioned at a top of the exterior 140 of the trough 130.

Temperature sensors (not shown) may be disposed within the trough and may be configured to sense a temperature of the material within the trough 130. For example, the sensors may measure a temperature from within the material and transmit a signal back to the control system 120 identifying the sensed temperature reading. Different materials may have ideal temperature to moisture profiles. For example, the temperature to moisture profile may identify a best temperature for a material over time as the material travels through the trough 130. The temperature sensors may sense a temperature of the material at different places/zones within the trough and provide this information to the control system 120. Furthermore, the control system 120 may compare the received temperature information to previously stored temperature to moisture profiles and determine whether the material is too hot (corresponding to too dry), too cold (corresponding to too wet), or within an acceptable range (corresponding to an acceptable dryness). For example, sludge may have a sweet spot of temperature between 240°-242° at the backend 134 of the trough.

Figure 2:
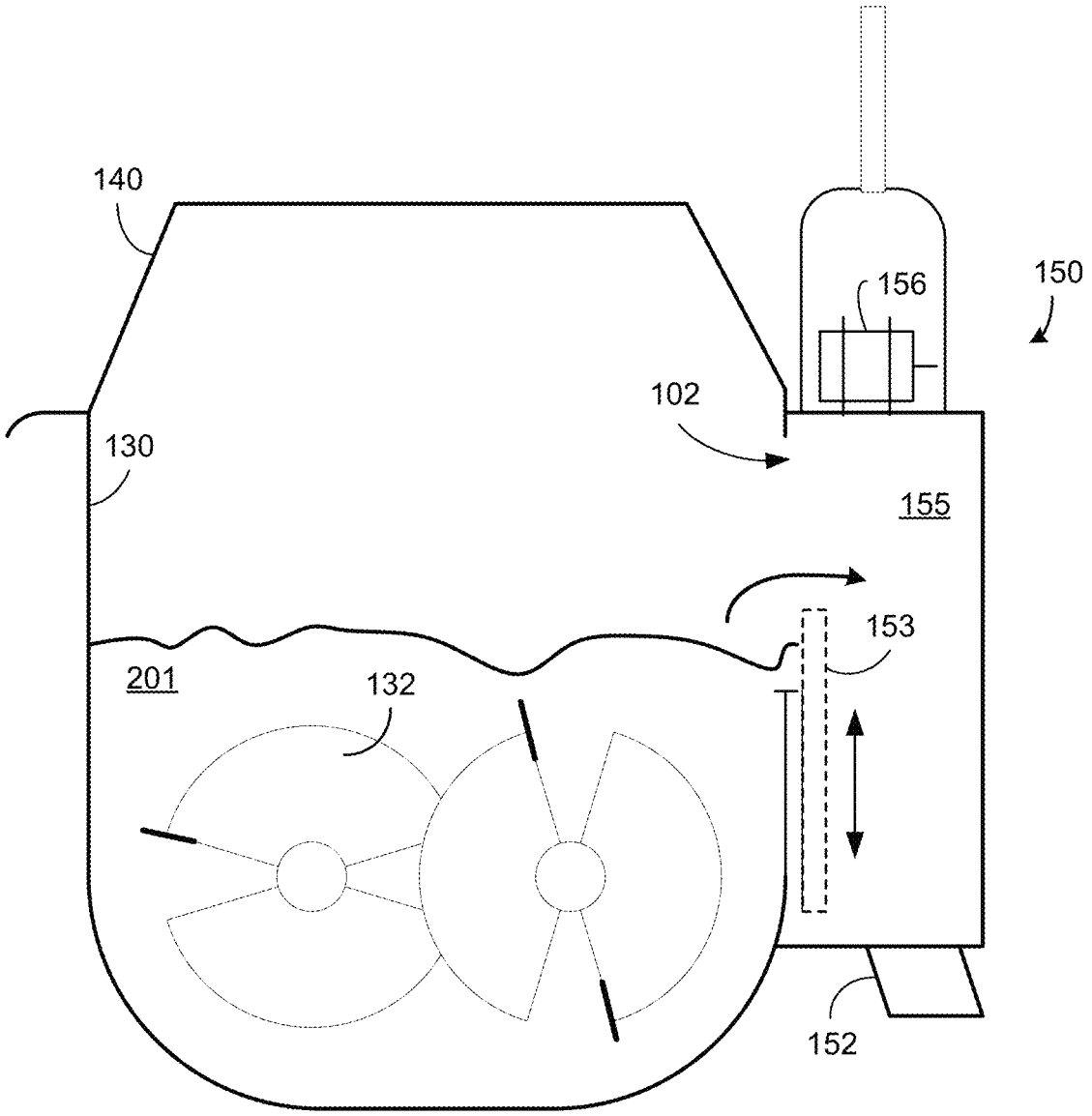
FIG. 2 is a diagram illustrating an example of a dynamically actuate weir of the paddle processor in accordance with an example embodiment.

FIG. 2 illustrates a dynamically actuated weir unit 150 of a paddle processor 100 in accordance with an example embodiment. For example, the view shown in FIG. 2 may be a cross-sectional view taken along line XY shown in FIG. 1. In this example, material 201 is held within the trough 130. The paddles 132 may process the material 201 creating a processed material. The control system 120 (in FIG. 1) may transmit a control signal to motor 156 within the weir unit 150 to control the overflow weir 153 to move up or down based on a temperature of the material 201. For example, the control system 150 may trigger the movement of the overflow weir upward to limit or otherwise decrease a size of the opening of the outlet 102 of the trough 130. Meanwhile, the control system 120 may also control the overflow weir 153 to move down and increase a size of the opening of the outlet 102 of the trough 130.

When the processed material finally overflows the weir 153 it will enter into a body 155 of the weir unit 150. The flow of the material out of the weir unit 150 may further be controlled by a discharge chute 152 which can allow the processed material to fall onto a surface, another machine, a bag, a platform, or the like.

According to various embodiments, if the control system 120 determines that the material 201 within the trough 130 is at a lower temperature than it should be, for example, based on a temperature to moisture profile of the material, the control system 120 may trigger the motor 156 to raise a height of the overflow weir 153 therein causing the material 201 to be restricted from leaving the trough 130. In other words, raising the overflow weir 153 will cause the processed material 201 to exit out of the trough 130 at a slower rate and speed or even stop the flow thereby causing the material 201 to be processed for a longer amount of time by the paddles 132. Likewise, if the control system 120 determines that the material 201 within the trough 130 is at a greater temperature than it should be, the control system 120 may trigger the motor 156 to lower the overflow weir 153 enabling the material 2101 within the trough 130 to leave at a faster rate of speed.

Figure 3A:
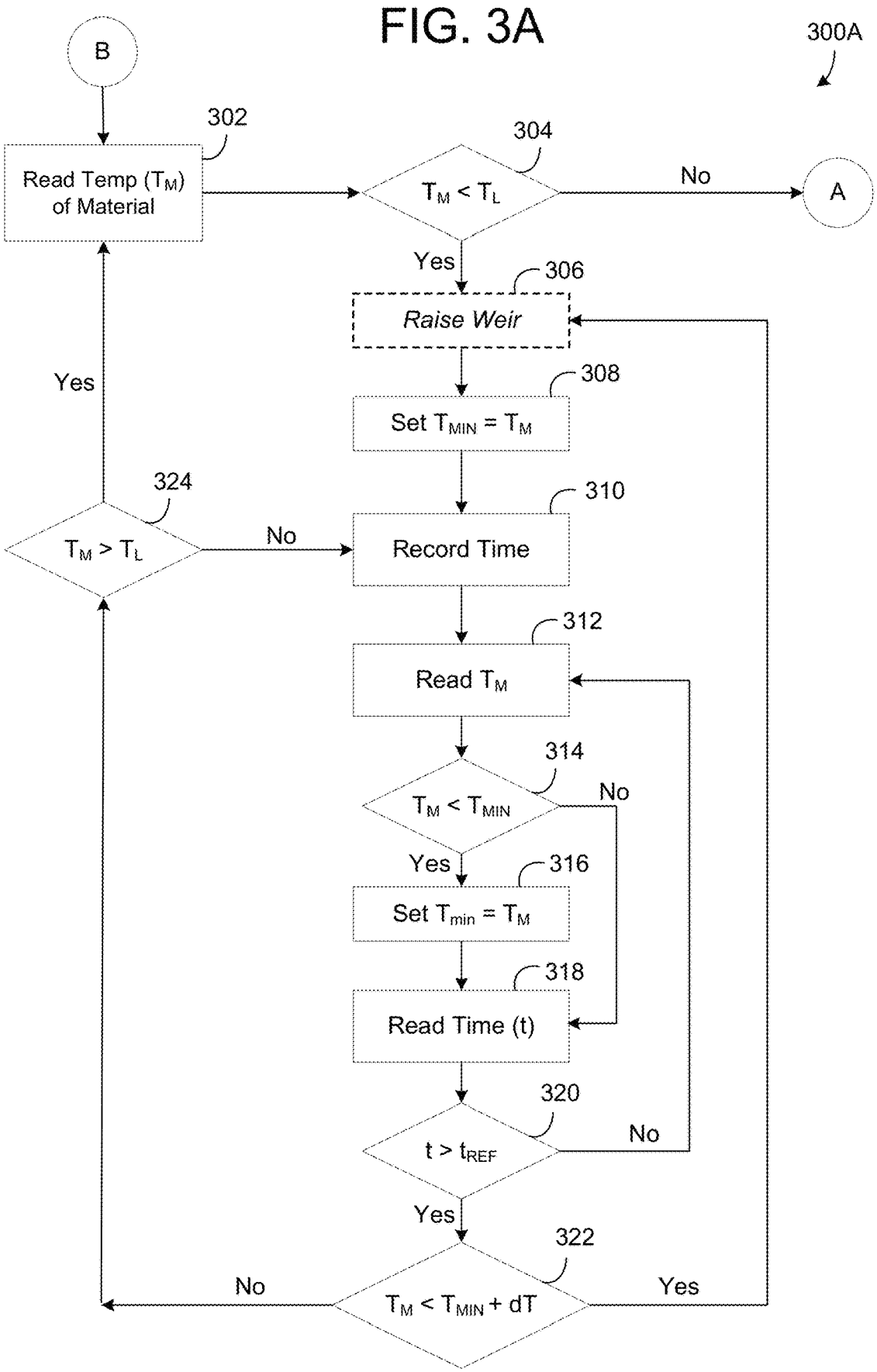
FIGS. 3A-3B are diagrams illustrating a process of controlling actuation of a weir in accordance with an example embodiment.
Figure 3B:
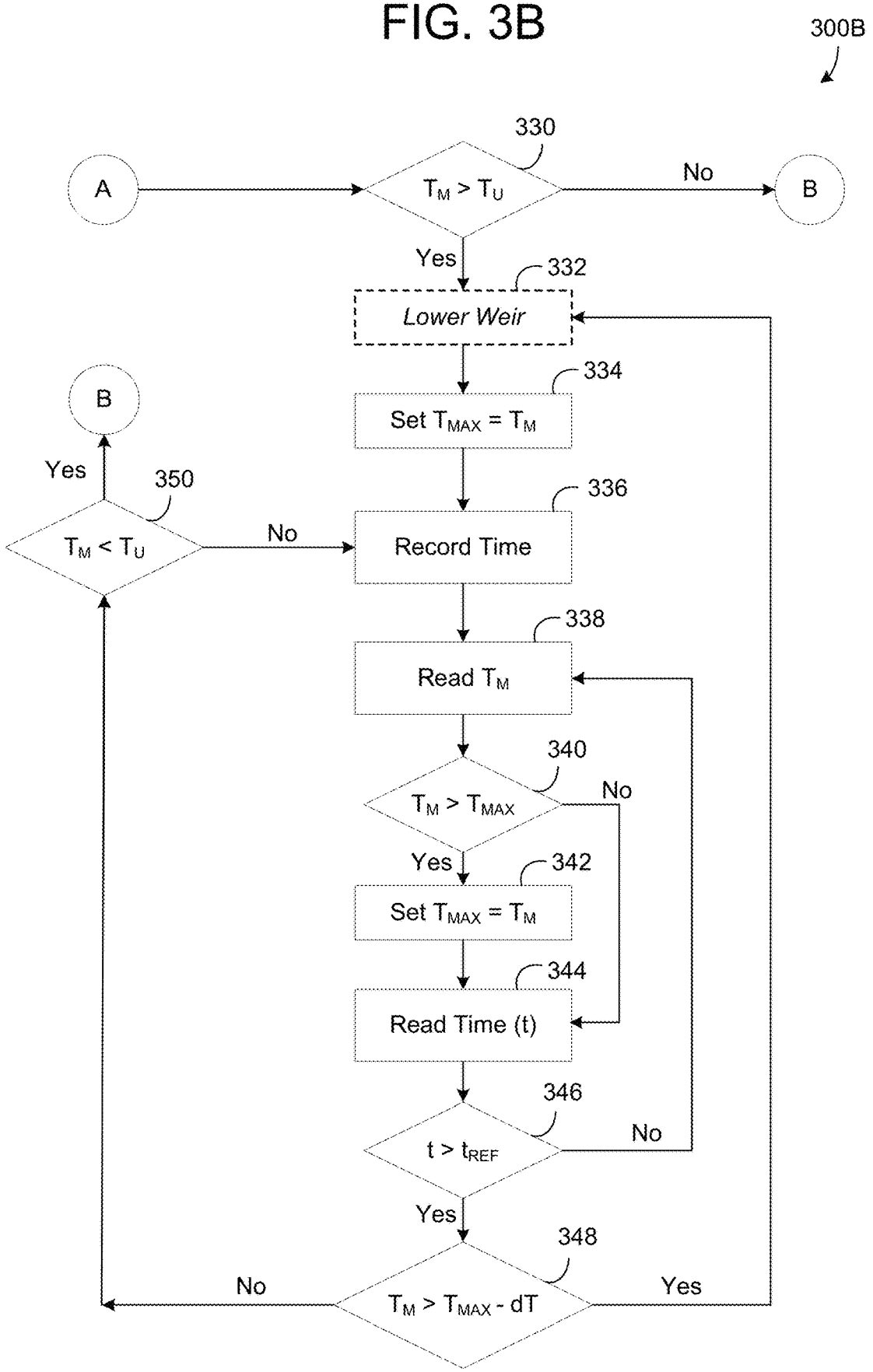

FIG. 3A illustrates a process 300A for raising a weir in accordance with an example embodiment, and FIG. 3B illustrates a process 300B for lowering a weir in accordance with an example embodiment. Here, the processes 300A and 300B may be performed together or sequentially by a control system or system chip of the paddle processor. In the examples of FIGS. 3A-3B, a material is fed through a paddle processor which includes temperature sensors for sensing a change in temperature of the material as it moves through the processor. An example of the paddle processor is shown in FIG. 1, but is not limited thereto. An overflow weir may be controlled based on temperature changes of the material which are sensed by the sensors. For example, if the temperature of the material falls outside of a predefined temperature range (e.g., lower limit to upper limit) the weir may be controlled accordingly.

Referring to FIG. 3A, in 302, a temperature of the material moving through the paddle processor is sensed. For example, the temperature may be sensed by one or more sensors configured to measure the temperature of a material within a trough of the paddle processor. In 304, the process determines whether the temperature of the material is less than a predefined lower temperature limit. If the material is not less than the lower limit, the process proceeds to 300B shown in FIG. 3B. On the other hand, if the temperature of the material is less than the lower limit, in 306, the control system may raise a height of the overflow weir which prevents material from moving out of the paddle processor and causes the material to build up more before it spills out over the overflow weir. This should prevent the material from being too wet when it leaves the paddle processor. The height may be raised based on an incremental basis where each increment is predefined.

In 308, the control system may set a dummy variable ($T_{MIN}$) as the temperature of the material and a current time is recorded in 310. Next, a time loop is started by the control system. In some embodiments, the motor activated weir should not be activated too frequently to allow the temperature of the material to adjust based on the changes in the overflow weir height. For example, an interval ($t_{REF}$) may be implemented with respect to the time recorded in 310 (e.g., 15 minutes, 20 minutes, etc.) giving the material in the paddle processor time to adjust. During this waiting period, the material temperature may be monitored between a loop of steps 312-320.

In 312, the temperature of the material is measured. In 314, the control system may determine whether the temperature is still getting lower or has not improved. If the temperature of the material falls below the dummy minimum temperature variable, in 314, the dummy minimum temperature variable may be updated in 316 to reflect the change to the lower temperature. The control system may be read time again, in 318. In 320, the control system may compare the time measured in 318 to the time recorded in 312 to determine if enough time has elapsed to satisfy the reference time ($t_{REF}$). If the reference time ($t_{REF}$) has not elapsed, steps 312-318 may be repeated. Otherwise, the process may proceed to step 322.

In 322, the control system may compare the temperature of the material to the minimum dummy temperature established by the loop of steps 312-318. If the temperature of the material is less than the dummy temperature plus a predefined minimum improvement temperature, the weir can be raised again, in 306, and the process may be repeated from 308. Otherwise, the control system may determine whether the temperature of the material is greater than the predefined lower temperature limit, in 324. If the lower temperature limit has been achieved, the control system may end the process or restart the process again at 302. As another example, if the lower temperature limit has not been achieved, the control system may proceed to step 310 and continue the process until the lower limit is reached based on incremental changes to the height of the overflow weir over specified increments of a predefined reference time.

FIG. 3B illustrates a process 300B which may be a continuation of the process 300A shown in FIG. 3A. Here, the control system may determine that the temperature of the material within the paddle processor satisfies a predefined lower limit, in 304, and may determine whether the temperature of the material also satisfies a predefined upper limit, in 330. It should also be appreciated that the processes 300A and 300B may be reversed. In other words, the control system may first determine whether the upper limit is satisfied and then determine that the lower limit is satisfied. As another example, the upper and lower limits may be analyzed simultaneously.

Referring to FIG. 3B, if the control system determines in 330 that the temperature of the material is not greater than the upper limit, the process may end or start over again at 302 of the process 300A in FIG. 3A. However, if the control system determines in 330 that the temperature of the material is greater than the upper limit, in 332 a height of the overflow weir may be lowered. The height may be incrementally lowered in predefined increments. By lowering the height of the overflow weir, the material may exit out of the paddle processor in less time because it will not need to build up as high before making it over the overflow weir. As a result, the material will spend less time in the paddle processor which should decrease the over-drying of the material.

In 334, the control system may set a dummy maximum temperature variable ($T_{MAX}$) as the temperature of the material and a current time is recorded in 336. Next, a time loop is started by the control system. As mentioned, the motor activated weir should not be activated too frequently to allow the temperature of the material to adjust based on the changes in the overflow weir height. Here, an interval ($t_{REF}$) may be implemented with respect to the time recorded in 336 (e.g., 15 minutes, 20 minutes, etc.) giving the material in the paddle processor to adjust. During this waiting period, the material temperature may be monitored through a continuous loop (e.g., steps 338-346).

In 338, the temperature of the material is measured. In 340, the control system may determine whether the temperature is still getting higher or has not improved. If the temperature of the material exceeds the dummy maximum temperature variable, in 342, the dummy maximum temperature variable may be updated to reflect the change to the lower temperature. The control system may read the time again, in 344. In 346, the control system may compare the time measured in 344 to the time recorded in 338 to determine if enough time has elapsed to satisfy the reference time ($t_{REF}$). If the reference time ($t_{REF}$) has not elapsed, steps 338-344 may be repeated. Otherwise, the process may proceed to step 348.

In 348, the control system may compare the temperature of the material to the maximum dummy temperature established by the loop of steps 338-346. If the temperature of the material is still greater than the maximum dummy temperature minus a predefined temperature improvement, the weir can be lowered again, in 332, and the process may be repeated from 334. Otherwise, the control system may determine whether the temperature of the material is less than the predefined upper temperature limit, in 350. If the material temperature is now less than the upper temperature limit, the control system may end the process or restart the process again at 302. As another example, if the upper temperature limit has not been achieved, the control system may proceed to step 336 and continue the process until the upper limit is reached based on incremental changes to the height of the overflow weir over one or more increments of a predefined reference time.

Figure 4:
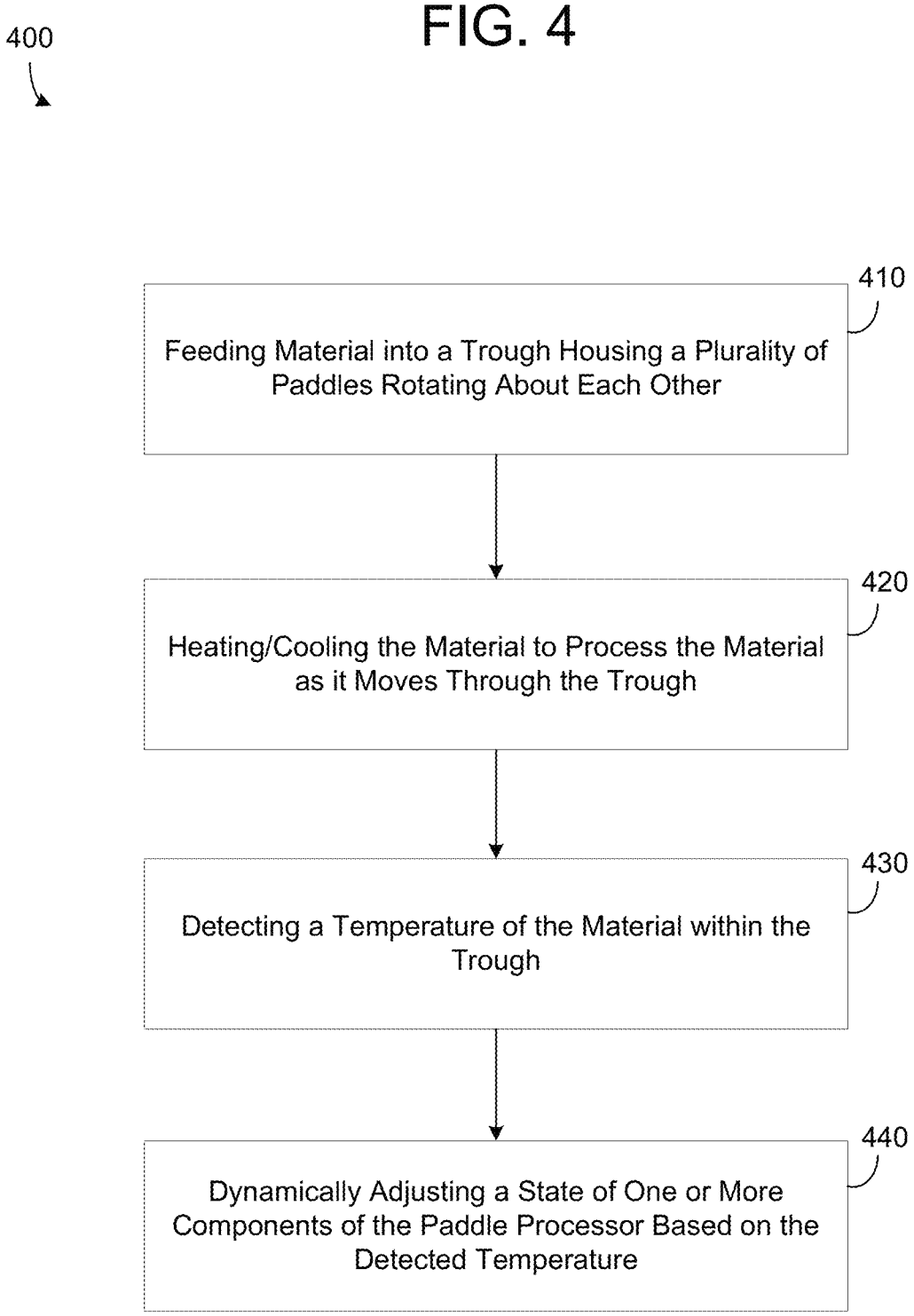
FIG. 4 is a diagram illustrating a method of changing a height of a weir based on a change in temperature in accordance with an example embodiment.

FIG. 4 illustrates a method 400 of changing a height of a weir based on a change in temperature in accordance with an example embodiment. For example, the method 400 may be performed by a paddle processor that includes a trough, a plurality of paddles within the trough, a control system, a dynamically actuated overflow weir, and the like. Referring to the example of FIG. 4, in 410, the method may include feeding material into an inlet of the trough housing the plurality of paddles rotating about each other causing the material to move towards an outlet of the trough. The material may include any type of material that can be dried via heating and/or cooling such as sludge, food, reactive mixtures, metals, and the like.

In 420, the method may include heating or cooling one or more of the rotational paddles to process the material while it is within the trough. For example, the control system may control the flow of a liquid or gaseous fluid into a hollow interior of the paddles for heating or cooling the material as the paddles come into contact with the material within the paddle processor. Alternative embodiments include heating or cooling part or all of the trough using a jacket through which liquid or gaseous fluid passes. As another example, a controller, a computer, a chip, or the like, may be used to control the heating/cooling of the paddles and/or trough. The paddles may be heated/cooled based on the type of material that is being processed. Different materials may have different temperature to moisture profiles. In some embodiments, the heating or cooling may include one or more of drying, pasteurizing, crystallizing, cooling, and causing a reaction within the material as it moves through the trough.

In 430, the method may include detecting a temperature of the material while it is within the trough, and in 440, dynamically adjusting a state of one or more components of the paddle processor based on a temperature of the material within the trough. For example, the method may include dynamically altering a height of the overflow weir associated with the outlet based on the detected temperature of the material thereby dynamically adjusting a rate at which the material exits the trough. In this example, the detecting may be performed by one or more temperature sensors or gauges disposed within the trough which transmit the sensed temperature to the control system.

As another example, the method may include automatically altering a temperature and/or a flow rate of thermal fluid running through one or more components of the trough such as a trough jacket, trough actuators, and the like. For example, the flow rate and/or the temperature of the thermal fluid may be increased which thereby increases the heat being applied to the material. As another example, the flow rate and/or the temperature of the thermal fluid may be decreased thereby decreasing the heat being applied to the material. In some embodiments, the method may include automatically altering a feed rate at which process material is fed into an inlet of the trough. For example, the feed rate may be decreased thereby increasing the amount of time that material spends in the paddle dryer and increasing the temperature of the material. As another example, the feed rate may be increased thereby decreasing the amount of time that material spends in the paddle dryer and decreasing the temperature of the material.

In some embodiments, the dynamically adjusting may include automatically increasing the height of the overflow weir in response to detecting the temperature is less than a predetermined temperature. As another example, the dynamically adjusting may include automatically decreasing the height of the overflow weir in response to detecting the temperature is greater than a predetermined temperature. In some embodiments, the dynamically adjusting the height (up or down) of the overflow weir is based on a temperature to moisture profile of the material.

The above descriptions and illustrations of processes herein should not be considered to imply a fixed order for performing the process steps. Rather, the process steps may be performed in any order that is practicable, including simultaneous performance of at least some steps. Although the disclosure has been described regarding specific examples, it should be understood that various changes, substitutions, and alterations apparent to those skilled in the art can be made to the disclosed embodiments without departing from the spirit and scope of the disclosure as set forth in the appended claims.

What is claimed is:

1. A paddle processor comprising:

a trough comprising an inlet to receive a feed of material and an outlet for exiting the material after processing;

rotational paddles disposed in the trough and configured to rotate about each other to move the material from the inlet to the outlet;

a temperature controller configured to transfer heat via one or more of the rotational paddles for processing the material within the trough;

an overflow weir which controls a rate at which the material exits the trough; and a control system configured to dynamically adjust a height of the overflow weir based on a temperature of the material within the trough.

2. The paddle processor of claim 1, wherein the overflow weir is disposed at a position where the material exits the trough.

3. The paddle processor of claim 1, wherein the control system is configured to dynamically increase a height of the overflow weir in response to the temperature of the material being less than a predetermined temperature.

4. The paddle processor of claim 1, wherein the control system is configured to dynamically decrease a height of the overflow weir in response to the temperature of the material being greater than a predetermined temperature.

5. The paddle processor of claim 1, wherein the control system is configured to dynamically adjust a height of the overflow weir based on a temperature to moisture profile of the material.

6. The paddle processor of claim 1, further comprising a motor connected to the overflow weir and configured to power the overflow weir up and down based on an actuation control signal from the control system.

7. The paddle processor of claim 1, wherein the temperature controller is configured to control the rotational paddles to one or more of dry, heat, cool, pasteurize, crystallize, and cause a reaction within the material as it moves through the trough.

8. The paddle processor of claim 1, wherein the overflow weir further comprises a chute that is configured to direct a flow of the material as it exits the outlet of the trough.

9. The paddle processor of claim 1, further comprising a plurality of temperature sensors configured to sense the temperature of the material within the trough and transmit the sensed temperature to the control system.

10. The paddle processor of claim 1, wherein the control system is configured to dynamically alter one or more of a temperature and a flow rate of thermal fluid of the trough based on the temperature of the material within the trough.

11. The paddle processor of claim 1, wherein the control system is configured to dynamically alter a feed rate of the material into the inlet of the trough based on the temperature of the material within the trough.

12. A method of controlling a paddle processor, the method comprising:

feeding material into an inlet of a trough that houses a plurality of paddles rotating about each other causing the material to move towards an outlet of the trough;

transferring heat via one or more of the plurality of paddles to process the material while it is within the trough;

detecting a temperature of the material while it is within the trough; and dynamically adjusting, via a control system, a height of an overflow weir based on a temperature of the material within the trough.

13. The method of claim 12, wherein the overflow weir is disposed at a position where the material exits the trough.

14. The method of claim 13, wherein the dynamically adjusting comprises automatically increasing or decreasing a height of the overflow weir based on the detected temperature of the material within the trough.

15. The method of claim 13, wherein the dynamically adjusting the height of the overflow weir is based on a temperature to moisture profile of the material.

16. The method of claim 12, wherein the dynamically adjusting comprises altering one or more of a temperature of thermal fluid of the trough and a feed rate of the material into the inlet of the trough based on the temperature of the material within the trough.

17. The method of claim 12, wherein the detecting is performed by one or more temperature sensors disposed within the trough which transmit the sensed temperature to a control system.

18. A paddle dryer comprising:

a trough comprising an inlet to receive a feed of material and an outlet for exiting the material after processing;

rotational paddles disposed in the trough and configured to rotate about each other to move the material from the inlet to the outlet;

an overflow weir disposed in association with the outlet and having a dynamically adjustable height for controlling a rate at which the material exits the trough; and a control system configured to dynamically adjust the height of the overflow weir based on a temperature of the material within the trough.

19. The paddle dryer of claim 18, wherein the control system is configured to automatically increase the height of the overflow weir in response to the temperature being less than a predetermined temperature.

20. The paddle dryer of claim 18, wherein the control system is configured to automatically decrease the height of the overflow weir in response to the temperature being greater than a predetermined temperature.

* * * * *